United States Patent [19]

Matsumura

[11] Patent Number: 4,887,061

[45] Date of Patent: Dec. 12, 1989

[54] TRANSFORMER FOR A FLYBACK TYPE CONVERTER

[75] Inventor: Tomoya Matsumura, Chiba, Japan

[73] Assignee: TDK Corporation, Tokyo, Japan

[21] Appl. No.: 292,007

[22] Filed: Dec. 30, 1988

[30] Foreign Application Priority Data

Jan. 18, 1988 [JP] Japan ..... 63-3819[U]

[51] Int. Cl.[4] ..... H01F 17/06; H01F 27/30

[52] U.S. Cl. ..... 336/178; 336/198

[58] Field of Search ..... 336/165, 178, 198, 208, 336/212, 233

[56] References Cited

U.S. PATENT DOCUMENTS 1,876,451 9/1932 Guntler ..... 336/178

4,009,460 2/1977 Fukui et al. ..... 336/178 X

*Primary Examiner*—Thomas J. Kozma

*Attorney, Agent, or Firm*—Martin M. Novack

[57] ABSTRACT

A pulse transformer for a flyback converter type switching power source has a ferrite core (10,11) with a pair of side legs (10*a*, 11*a*) and a center leg (10*b*, 11*b*) which is shorter than said side leg so that an air gap G is provided in the magnetic path along the center leg, and the windings on a bobbin (15) on said ferrite core is improved by positioning said gap G at the end portion of the center leg close to the end of the bobbin, and a dielectric belt (16*b*) on the bobbin (15) so that no winding exists around said gap. Thus, leakage flux around said gap does not interlink with the windings, and no eddy current flows in the windings, and a partial temperature raise in the windings is prevented.

5 Claims, 3 Drawing Sheets

TRANSFORMER FOR A FLYBACK TYPE CONVERTER

BACKGROUND OF THE INVENTION

The present invention relates to a high frequency pulse transformer which has an air gap along a magnetic path by a ferrite core, and in particular, relates to such a transformer which is used for voltage conversion in a switching power source of a flyback converter type.

FIG. 5 shows a circuit diagram of a flyback converter type switching power source, in which the symbol B is a DC power source, T is a transformer, TR is a transistor, CT is a control circuit, $D_s$ is a diode, $C_s$ is a capacitor, and $Z_L$ is a load. The transistor TR switches ON and OFF repetitively according to the control of the control circuit CT. When the transistor TR is in ON state, the current flows from the DC power source B, through the primary winding $N_p$ of the transformer T, the transistor TR, to the DC power source B. Then, the energy is stored in the transformer T when the transistor TR is in ON state. That energy stored in the transformer T is proportional to $\frac{1}{2}LI^2$, where L is inductance of the primary winding $N_p$, and I is current in the primary winding $N_p$. Next, when the transistor is in OFF state, that energy is released to the load $Z_L$ through the diode $D_s$ and the capacitor $C_s$ which functions as a rectifier and a smoother. Therefore, the inductance L of the primary winding must have the proper value so that a lot of energy is stored in the transformer during the ON state of the transistor, although an usual transformer for voltage conversion has inductance as large as possible.

If the inductance L is too large, the current I would be small, and the stored energy would be small. Similarly, if the inductance is too small, the stored energy would also be small although the current I is large.

Therefore, it is preferable that a transformer for a flyback converter type switching power source has an air gap in a magnetic path for reducing or having proper inductance.

We first tried this kind of high frequency pulse transformer for switching power source, as shown in Fig. 3, in which a pair of E-shaped ferrite cores 1 abutted each other, an air gap G provided in a center leg of the core, and a bobbin with a winding on said center leg 2. The air gap G is essential in a transformer of a flyback converter type switching power source for storing electromagnetic energy.

However, we found that the transformer as shown in Fig. 3 in which an air gap G is provided at the center portion of the center leg 2 has the disadvantage that leakage flux $\phi$ which leaks from said air gap G interlinks with a winding 3 as shown in FIG. 4, and the winding 3 is subject to eddy current loss. Therefore, the temperature of the winding 3 is raised partially. That disadvantage is serious when the capacity of the transformer is large, like a transformer for a switching power source.

SUMMARY OF THE INVENTION

The object of the present invention is to overcome the disadvantages and limitations of a prior pulse transformer by providing a new and improved pulse transformer.

It is also an object of the present invention to provide a pulse transformer which is free from eddy current loss in a winding by the presence of an air gap, so that the partial high temperature is prevented, and the power efficiency of the transformer is improved.

The above and other objects are attained by a high frequency pulse transformer having a ferrite core (10,11) having a pair of side legs (10*a*, 11*a*) and a center leg (10*b*, 11*b*) which is shorter than said side leg, so that a gap G is provided on the center leg, and an arm (10*c*, 11*c*) connecting said side legs with said center leg; a bobbin (15) having a cylindrical hollow center body (15*a*) and a pair of flanges (15*b*), having windings on said hollow center body, assembled with said ferrite core so that said center leg is inserted into the hollow center body of the bobbin; said gap G being located at end of said center leg (10*a*) under one of the extreme ends of said hollow center body of the bobbin (15); and no coil means (16*a*, 16*b*) being provided for allowing no winding in a predetermined length from said gap.

Preferably, said no coil means is a belt provided at the end of the hollow center body of the bobbin.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1A:
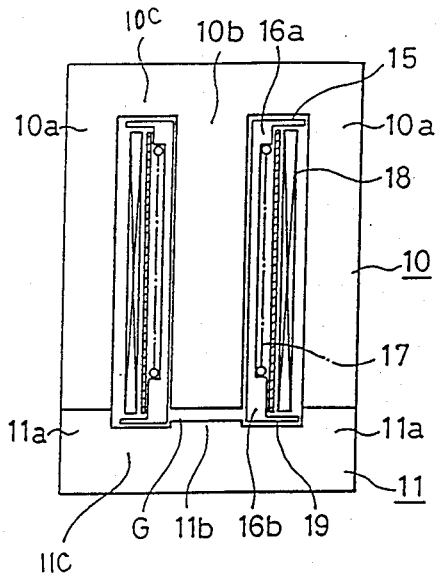
FIG. 1A is a cross sectional view of a high frequency pulse transformer according to the present invention.
Figure 1B:
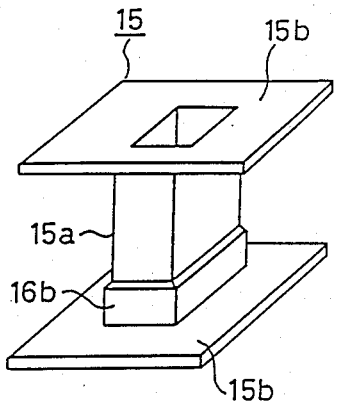
FIG. 1B is a perspective view of a bobbin of the transformer of FIG. 1A, FIGS. 2A, 2B and 2C show perspective views of a core for explaining manufacturing process of the core of the present transformer.
Figure 2A:
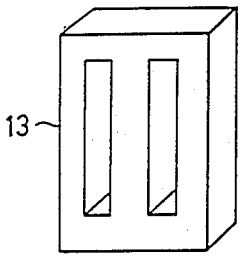
Figure 2B:
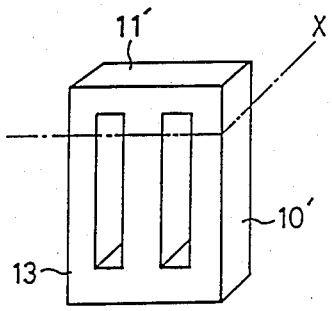
Figure 2C:
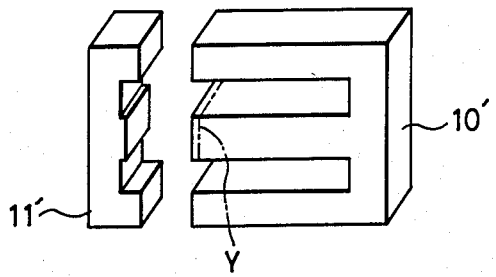
Figure 3:
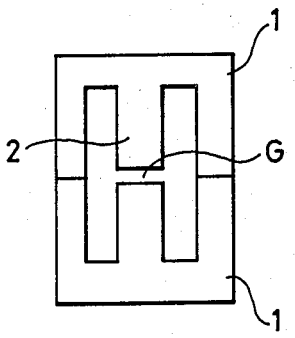
FIG. 3 PRIOR ART
FIG. 3 shows a core of a prior pulse transformer.
Figure 4:
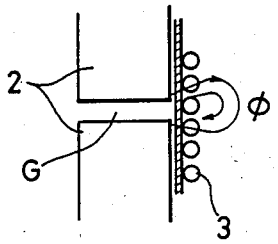
FIG. 4 PRIOR ART
FIG. 4 is an enlarged partial view of a prior pulse transformer which has a winding.
Figure 5:
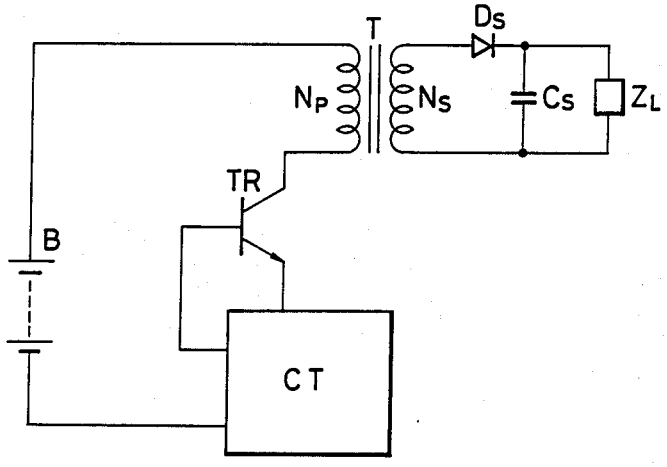
FIG. 5 PRIOR ART
FIG. 5 is a circuit diagram of a prior flyback converter type switching power source.

FIG. 1 shows a cross section of the high frequency pulse transformer according to the present invention, and FIGS. 2A through 2C show the producing steps of a core of the transformer.

In FIG. 1, the numeral 10 is an E-shaped ferrite core having a pair of long side legs 10*a*, a long center leg 10*b*, and an arm 10*c* coupling the side legs 10*a* with the center leg 10*b*. The numeral 11 is a second E-shaped ferrite core having a pair of short side legs 11*a*, a short center leg 11*b*, and an arm 11*c* coupling the side legs 11*a* with the center leg 11*b*.

The first E-shaped core 10 and the second E-shaped core 11 are manufactured as shown in FIGS. 2A through 2C. First, a closed ferrite core having a pair of windows as shown by the numeral 13 in FIG. 2A is shaped and sintered. Next, the core 13 is separated to two portions 10' and 11' as shown in FIG. 2B by cutting the core 13 along the line X so that a pair of asymmetrical E-shaped cores are obtained. Next, the center leg of one of the E-shaped cores is ground so that the center leg becomes shorter than the side legs by removing the portion Y as shown in FIG. 2C. It is a matter of design choice whether the center leg of the E-shaped core with the longer side legs (and the center leg) is ground as shown in FIG. 2C, or the center leg of the E-shaped core with the shorter side legs is ground.

A bobbin 15 has a cylindrical hollow body 15*a* and a pair of flanges 15*b* at the ends of the body 15*a*. The center body 15*a* has a pair of belts 16*a* and 16*b* at the extreme ends of the body 15*a*, so that the center body 15*a* is thicker at the ends than other portion of the center body l5*a* of the bobbin 15.

A primary winding 17 of the transformer is wound on the non-thicked portion of the bobbin 15 (a primary winding 17 is not wound on the belts 16*a* and 16*b*). A secondary winding 18 of the transformer is wound on the primary winding 17 and the belts 16*a* and 16*b* through the insulation layer 19.

The pair of E-shaped cores 10 and 11, and the bobbin 15 with the windings are assembled together, so that the center leg 11*b* of the E-shaped core 10 is inserted into the hollow body 15*a* of the bobbin 15, and the side legs 10*a* of the E-shaped core 10 touches with the side legs 11*a* of the other E-shaped core 11. It should be noted that an air gap G is provided between the center legs 10*b* and 11*b* of the pair of E-shaped cores 10 and 11, and that said air gap G is positioned under the belt 16*b* where no primary winding is provided.

Therefore, even if a leakage flux exists around the air gap G, the leakage flux around the air gap G does not interlink with the primary winding nor the secondary winding because of the presence of the belt 16*b* on the bobbin 15. Therefore, no eddy current loss because of the leakage flux occurs in the windings, and so, the partial high temperature in the windings is prevented.

Accordingly, the insulation breakdown due to a partial over heat is prevented, and the operational reliability of a transformer is improved. Further, the insulation material for a lower temperature standard may be used for the present transformer (for instance, B type 130° C. insulation material for a prior transformer may be replaced by A type 105° C. insulation material in the present invention).

Further, because of the lack of eddy current loss, the conversion efficiency of a transformer is improved. Therefore, the size of a transformer and/or a ferrite core may be smaller than in the prior art.

As a modification, the combination of an E-shaped core and an I-shaped core is of course possible in the present invention, although the embodiment describes the combination of a pair of E-shaped cores. Further, the cross section of a center leg may either be rectangular, or circular.

From the foregoing it will now be apparent that a new and improved transformer has been discovered. It should be understood of course that the embodiments disclosed are merely illustrative and are not intended to limit the scope of the invention. Reference should be made to the appended claims, therefore, rather than the specification as indicating the scope of the invention.

What is claimed is:

1. A transformer for a flyback converter type switching power source comprising;

a ferrite core (10,11) having a pair of side legs (10*a*, 11*a*) and a center leg (10*b*, 11*b*) which is shorter than said side legs, so that a gap G is provided on the center leg, and arms (10*c*, 11*c*) connecting said side legs with said center leg, a bobbin (15) having a cylindrical hollow center body (15*a*) and a pair of flanges (15*b*), having windings on said hollow center body, assembled with said ferrite core so that said center leg is inserted into the hollow center body of the bobbin, said gap G being located at end of said center leg (10*a*) under one of the extreme ends of said hollow center body of the bobbin (15), and no coil means (16*a*, 16*b*) being provided for allowing no winding in predetermined axial and radial lengths from said gap.

2. A transformer according to claim 1, wherein said no coil means is a belt provided at the end of said hollow center body of said bobbin.

3. A transformer according to claim 1, wherein said ferrite core is a combination of a pair of E-shaped cores.

4. A transformer according to claim 1, wherein said ferrite core is combination of an E-shaped core and an I-shaped core.

5. A transformer according to claim 2, wherein a primary winding is provided on non-belt portion of the hollow center body, and a secondary winding is provided on the whole length of the hollow center body through an insulation layer on the primary winding.

* * * * *